United States Patent [19]

Browand

[11] 4,003,040

[45] Jan. 11, 1977

[54] FLASHING ADDRESS-INDICATING DOOR SIGN

[76] Inventor: Cecil Carlton Browand, 5616 Reiter Ave., Las Vegas, Nev. 89108

[22] Filed: May 30, 1975

[21] Appl. No.: 582,287

[52] U.S. Cl. ..... 340/332; 200/156; 340/331

[51] Int. Cl.[2] ..... G08B 5/00

[58] Field of Search ..... 340/332, 330, 286, 326, 340/107, 328, 331, 371; 200/155 R, 156

[56] References Cited

UNITED STATES PATENTS

| | | | |
|---|---|---|---|
| 1,080,167 | 12/1913 | Quertier | 340/286 |
| 1,606,404 | 11/1926 | Eastman | 340/330 |
| 2,054,955 | 9/1936 | Stepham | 340/330 |
| 2,498,651 | 2/1950 | Crom | 200/11 R |
| 2,669,649 | 2/1954 | Webster | 200/155 R |
| 3,360,791 | 12/1967 | Lazar | 340/330 |
| 3,599,201 | 8/1971 | Clardy et al. | 340/326 |
| 3,863,236 | 1/1975 | Clardy | 340/326 |

*Primary Examiner*—John W. Caldwell
*Assistant Examiner*—James J. Groody
*Attorney, Agent, or Firm*—Edward J. Quirk

[57] ABSTRACT

A flashing door sign comprises a casing having illuminable house numbers at the front thereof. The casing contains red and white light bulbs which are selectively operable by a switch located inside of the house; the switch has positions corresponding to a continuous white light, flashing white light, and flashing red light to indicate an emergency. The switch must be moved in a non-rotational direction to enter the emergency position.

2 Claims, 4 Drawing Figures

FLASHING ADDRESS-INDICATING DOOR SIGN

BACKGROUND OF THE INVENTION

Lighted signs for use on the exterior of a house or other type of building are well known. These signs generally comprise a casing having a light therein which projects through transparent portions of a front panel to outline the street number of the building. Persons paying social calls or visiting to transact business at a residence after dark in an unfamiliar neighborhood generally locate the house by the street number; these lighted door signs facilitate the finding of a specific location. Even with these illuminable signs, finding a particular residence may be quite difficult, especially if the house is set well back from the street, such that the sign numbers are difficult to read, or if the numbers are partially obscured by trees or bushes.

There is also a need for an inexpensive method of quickly alerting passersby of an emergency existing in a home. While numerous burglar or fire alarm type devices which sound remotely in a fire or police station are available, these are very costly for the average homeowner. In many neighborhoods, full time security guards patrol the streets after dark to ward off intruders and to answer emergency calls. In many cases, the security cars are not radio equipped and must therefore return to a home base to obtain these calls. A need exists for a method of summoning such security guards visually from the home. In addition, if an emergency vehicle such as a police car, fire engine, or ambulance responds to a house call, there is a need for a device which will immediately inform the drivers of the vehicle which residence made the emergency call.

As indicated above, signs having lighted street numbers are well known. For example, Pinkus, U.S. Pat. No. 1,806,915, McCann, U.S. Pat. No. 2,157,772, and Gurian, U.S. Pat. No. 3,212,080 all disclose sign boxes having lighted street numerals in combination with door bells. Lazar, U.S. Pat. No. 3,360,791 discloses an illuminable street sign having the light therein operable either from inside the house or from a post located near the street. However, none of these devices have the ability to immediately alert either a social visitor or an emergency vehicle that they have found the correct residence.

Alarm-type devices are also known; in addition to the standard remotely sounding signals already mentioned, several alarms have been disclosed which are visually observable near the location of the emergency. For example, Pijakowski, U.S. Pat. No. 1,700,950, describes an audio/visual alarm indicating that help is needed on the inside of a building. Clardy, U.S. Pat. No. 3,599,201 discloses a tubular ground-anchored lamppost having audio and flashing visual alarms, actuable from inside a home, to signify an emergency. This system is substantially more complex and expensive than applicant's device, and does not serve to illuminate a house number.

Accordingly, it is an object of the invention to provide an illuminated door sign for display of street numbers which is relatively simple and inexpensive, and which contains a flashing device for flashing the light therein on and off to alert passersby searching for the house.

It is another object of the invention to provide an illuminated door sign which contains a selectively actuable flashing red emergency light.

SUMMARY OF THE INVENTION

An electrically lighted sign for identifying the street location of a residence comprises a housing adapted to be mounted on the exterior of the residence and having a transparent indicia-carrying front surface, a light enclosed by the housing, a flasher for rapidly turning the light on and off, and a switch located inside the residence having one position for continuous energization of the light and a second position for rapid intermittent energization of the light.

DETAILED DESCRIPTION OF THE INVENTION

Figure 1:
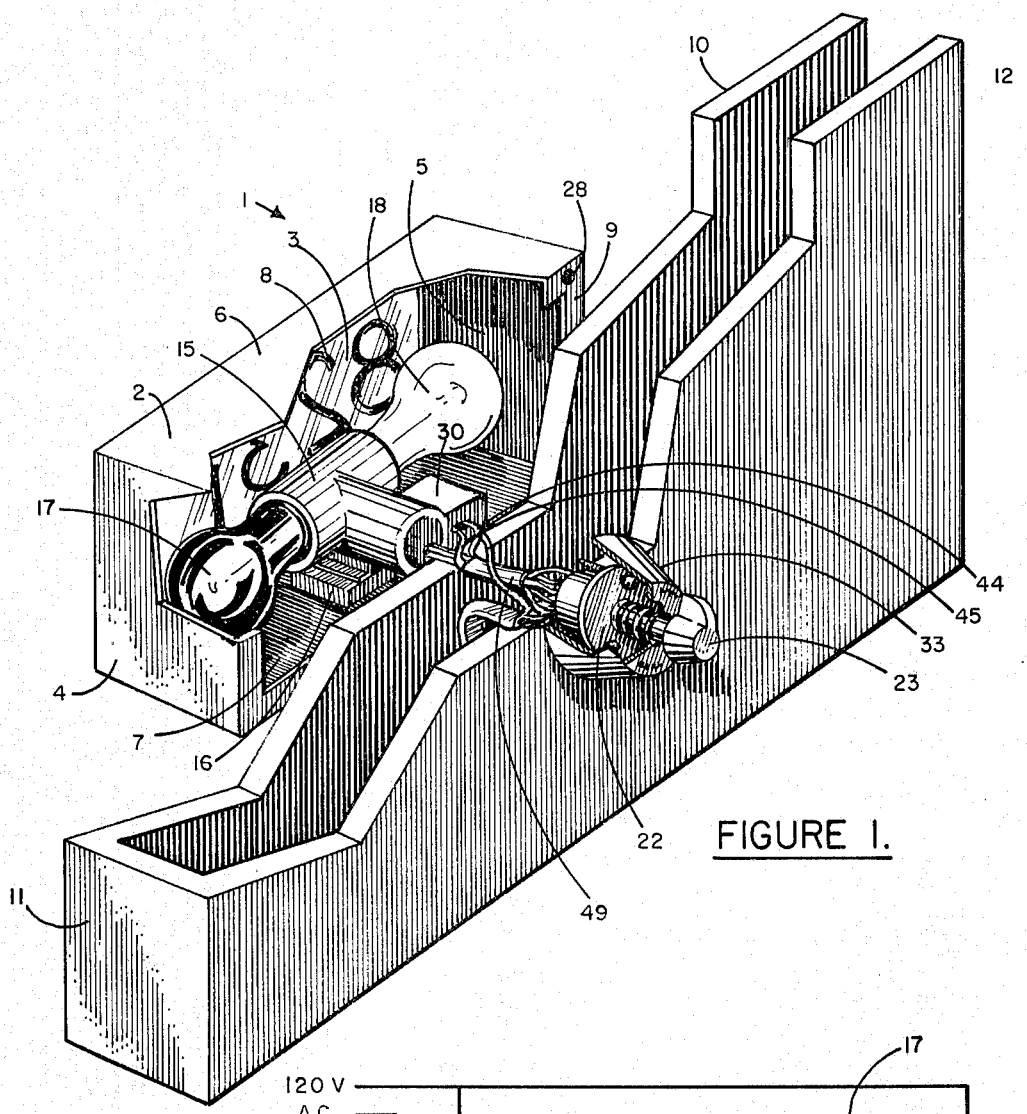
FIG. 1 is a perspective exploded cutaway view of a sign unit and switch of the invention.

Referring to FIG. 1, electrically illuminated sign 1 comprises a housing 2 having a transparent plastic front plate 3, side walls 4 and 5, top wall 6, and bottom wall 7. The front transparent plate carries numerals 8 which designates the address of the house. The numerals applied to the plate are simply flexible preformed decals having an adhesive backing. The back of the housing is open for convenient access to the inside of the housing, except for lip 9 extending around the periphery of the back edge of the housing. Aperture 28 in the lip serves to mount the unit on nails or hooks driven in the exterior 10 of wall 11 of the residence. Other mounting holes similar to aperture 28 are located along the lip 9; for mounting, the unit can simply be set in place by sliding the holes over nails extending from the wall.

Double light socket 15 is mounted by screws (not shown) on base 16 on floor 7 of the housing. Red light bulb 17 and white light bulb 18, both 25 watts rating, are screwed into the fixtures of socket 15.

Figure 3:
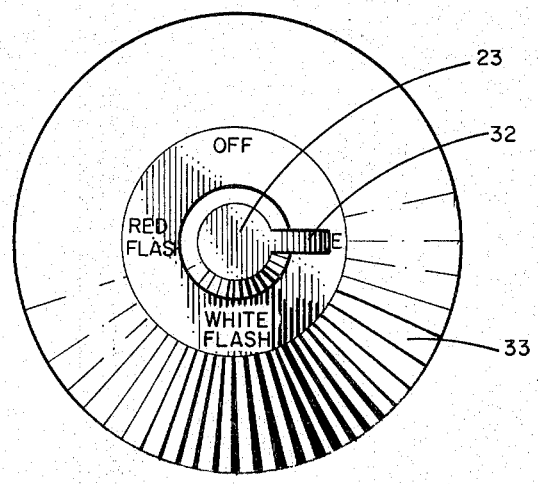
FIG. 3 is a front view of the switch.

Control switch 20 is a conventional four-position double pole switch having positions corresponding to "off", "white light", "white flash", and "red flash", as shown in FIG. 3. The switch is mounted on the inside surface 12 of wall 11 with mounting screws 25 extending through holes 21 in shelf 22 in casing 33. Knob 23 can be rotated to the off, white light, and white flash positions simply by turning the knob; however, to rotate the knob to the red flash position, the knob must first be pushed inwardly and then rotated. The knob is biased towards its normal or outer position by helical spring 24; accordingly, when the knob is rotated away from the red flash position it will be returned to the outer position. This safety feature prohibits the knob from being turned accidentally to the emergency position, or from being activated by small children.

Figure 2:
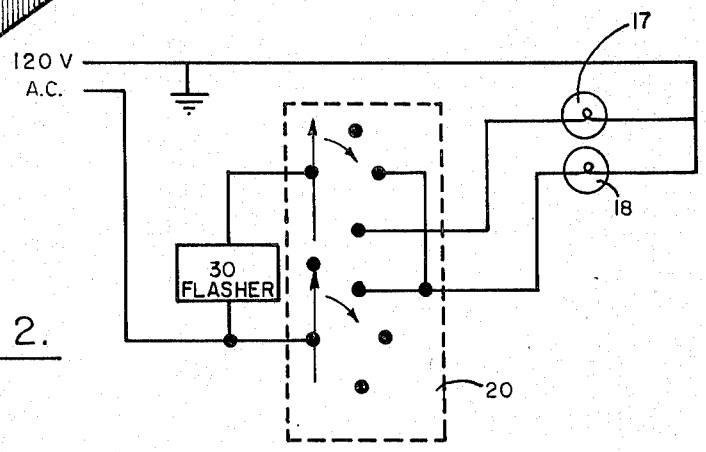
FIG. 2 is a schematic electrical circuit diagram for the sign.
Figure 4:
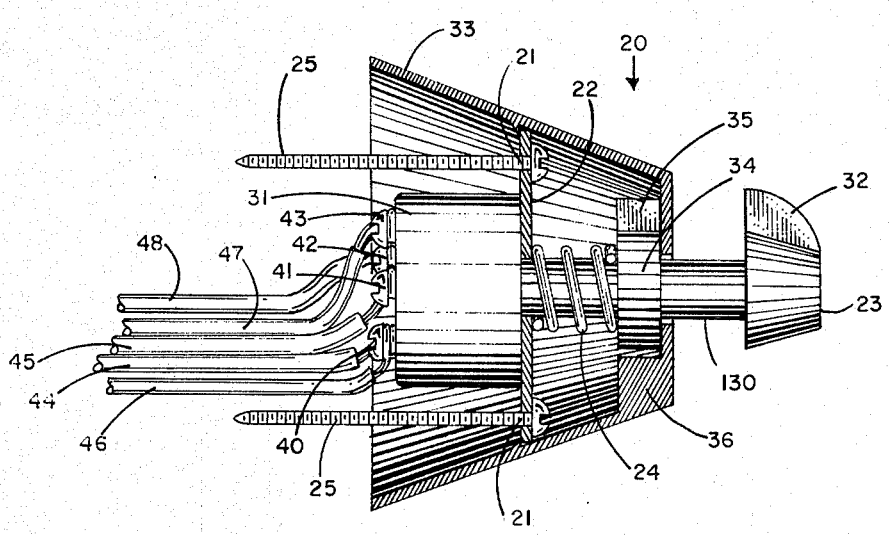
FIG. 4 is a partially sectional side view of the switch.

Details of the switch are shown in FIG. 4. Knob 23 is mounted on rotatable shaft 130 which engages and disengages electrical contacts contained in housing 31, wired as shown in FIG. 2. Pointer 32 on the knob acts as an indicator to show the operating position of the switch. The switch is enclosed in protective casing 33. A concentric collar 34 is fixedly mounted concentrically around the shaft; lug 35 is a tooth-shaped projection extending outwardly from the collar in alignment with the pointer 32. The knob can be freely rotated from position to position except for the red flash position. As the pointer is turned toward this position, lug 35 engages abutment or block 36 located on the inside of the protective casing 33. This abutment extends slightly less than one-quarter of the circumference of the casing, extending an equal distance on each side of the red flash setting, such that any effort to turn knob 23 from either the off or the white flash positions will cause the lug to engage the abutment and prevent further turning. When the knob is depressed, lug 35 extends underneath abutment 36 and the switch may be turned to the red flash position.

Four terminals 40, 41, 42, and 43 are shown on the switch. The flasher is connected across terminals 40 and 41 by leads 44 and 45. The positive lead of house current is also attached to terminal 40 with lead 46. The red and white lights are connected to terminals 42 and 43 with leads 47 and 48. House negative is attached to lead 49. The remaining wiring is internal within housing 31 and is shown only in the schematic circuit diagram in FIG. 2. As is apparent from the diagram, conventional electro flasher 30 is in series with the white bulb when the switch is in the white flash position, and is in series with the red bulb when the switch is in the red flash position. As indicated, the unit operates from standard household current. While this switch is shown as an example of one type of switch which can be used in the sign of the invention, any switch which accomplishes the purpose of the invention may be used.

The normal use of the sign is as follows. During daylight hours, the switch will remain in the off position, with both lights off. During the hours of darkness, the white light will remain continuously lighted, with the switch in the first or white light operating position, to identify the house to passersby. If the residents are expecting a visitor, they will inform the visitor of the location of the house and of the flashing sign; the switch will then be moved to the second or white flash position and will be easily visible to the visitors. The red flash position of the switch will only be used in case of emergency, to notify security guards, passersby, or emergency vehicles of an emergency existing in the house.

The transparent plate in the front of the sign may be platic, such as plexiglas of about ¼ inch thickness, or may be clear or frosted glass. The house numbers may then easily be applied to the plate, by adhesion as discussed above, or by painting or any other method such that the numbers are visible from a distance. In the alternative, the front panel may be opaque and the numbers may be cut directly into the panel, giving the effect of lighted numbers on a dark surface. It is essential only that the numbers be defined by the lights. If desired, indicia other than house numbers, such as the name of the occupants, may be placed on the front panel.

The device of the invention accomplishes the objectives of an easily manufactured, inexpensive sign which serves to indicate a house number, alert visitors to the house, and flash a warning in the event of an emergency. The sign is easily installed by a homeowner without special tools or assistance.

While one specific example of a flashing lighted sign of the invention has been disclosed in detail, many modifications and alternatives within the spirit and scope of the invention will be apparent to those skilled in the art. Accordingly, the invention should be limited only by the following claims.

I claim:

1. An electrically illuminated sign mountable on the exterior of a residence comprising:

a housing having a front wall and side walls, said front wall being at least partially transparent, indicia indicating the house number of a residence, said indicia being carried by the front wall such that the indicia are clearly outlined when the sign is illuminated, white light means and red light means enclosed by said housing, flasher means for rapidly turning the red and white light means on and off, switch means mountable inside the residence having a first operating position, a second operating position, and a third operating position, a source of conventional AC power, circuit means for operatively electrically connecting said power source to said white light means when the switch means is in the first operating position and operatively electrically connecting said power source to said white light means and the flasher means when the switch is in the second operating position, and for operatively electrically connecting said power source to said red light means and the flasher means when the switch is in the third operating position, and mounting means for attaching the housing to the exterior of the residence.

2. The sign of claim 1 wherein the switch means comprises a knob for selecting operating positions, said knob being rotatable to the first and second operating positions, the switch also comprising blocking means to prevent rotation of the knob to the third operating position until the knob has first been moved in a non-rotational direction.

* * * * *